US008556192B2

(12) United States Patent
Wise

(10) Patent No.: US 8,556,192 B2
(45) Date of Patent: Oct. 15, 2013

(54) PORTABLE PRESSURE WASHER

(76) Inventor: Todd W. Wise, Barrington, RI (US)

( * ) Notice: Subject to any disclaimer, the term of this patent is extended or adjusted under 35 U.S.C. 154(b) by 449 days.

(21) Appl. No.: 12/871,033

(22) Filed: Aug. 30, 2010

(65) Prior Publication Data

US 2012/0241014 A1 Sep. 27, 2012

(51) Int. Cl.

| | |
|---|---|
| ***B05B 1/30*** | (2006.01) |
| ***B05B 9/08*** | (2006.01) |
| ***B05B 9/06*** | (2006.01) |
| ***A01G 25/09*** | (2006.01) |

(52) U.S. Cl.

USPC ..... 239/146; 239/575; 239/526; 239/152; 239/305; 239/310; 222/134; 401/46; 220/501

(58) Field of Classification Search

USPC ..... 239/329, 462, 553, 575, 590, 526, 527, 239/152–154, 310, 305, 307, 146; 210/416.1, 470, 471; 222/129, 134; 401/6, 44, 45, 46, 47; 220/23.2, 23.4, 220/23.6, 23.83, 23.86, 501, 502, 503, 505, 220/507, 565, 219

See application file for complete search history.

(56) References Cited

U.S. PATENT DOCUMENTS

| | | | | |
|---|---|---|---|---|
| 626,469 | A * | 6/1899 | Taylor | 239/143 |
| 888,693 | A * | 5/1908 | Aranguren Y Bustinza | 239/305 |
| 2,003,847 | A * | 6/1935 | Woods | 134/6 |
| 5,022,547 | A * | 6/1991 | Spangler et al. | 220/23.4 |
| 5,100,058 | A | 3/1992 | Wei | |
| 5,169,068 | A | 12/1992 | Bertolini | |
| 5,421,520 | A | 6/1995 | Simonette et al. | |
| 5,671,884 | A | 9/1997 | Restive | |
| 5,857,618 | A | 1/1999 | Restive | |
| 5,938,116 | A | 8/1999 | Restive et al. | |
| 5,984,199 | A | 11/1999 | Restive | |
| 6,015,100 | A | 1/2000 | Restive | |
| 6,446,881 | B1 * | 9/2002 | You | 239/146 |
| 6,565,015 | B2 | 5/2003 | Leer et al. | |
| 6,571,805 | B2 * | 6/2003 | Hoenisch et al. | 134/22.12 |
| 7,198,204 | B2 | 4/2007 | Bennett et al. | |
| 7,753,290 | B2 | 7/2010 | Jacques et al. | |
| 2007/0125878 | A1 | 6/2007 | Hahn et al. | |
| 2007/0182158 | A1 | 8/2007 | Cerney et al. | |
| 2007/0187528 | A1 * | 8/2007 | Roth et al. | 239/146 |
| 2007/0187529 | A1 * | 8/2007 | Tracey et al. | 239/196 |
| 2007/0264138 | A1 | 11/2007 | Mandell et al. | |
| 2009/0173753 | A1 | 7/2009 | Conner et al. | |
| 2009/0269218 | A1 | 10/2009 | Gardner et al. | |

* cited by examiner

*Primary Examiner* — Len Tran
*Assistant Examiner* — Justin Jonaitis
(74) *Attorney, Agent, or Firm* — Salter & Michaelson

(57) ABSTRACT

A portable pressure washer that includes a base and a tank assembly formed as a one-piece structure and for engagement with the base. The tank assembly has a pair of water tanks that are disposed separately from each other and a solution tank that is disposed between the pair of water tanks. Each of the tanks is provided with a filler cap. A latch mechanism is disposed at opposite ends of the base for releasably securing the tank assembly with the base. The base houses a liquid pump and air compressor. A manual selector is mounted at the base and has separately selectable positions for coupling either with the water tanks or the solution tank. A spray hose is coupled from the pump for directing either of the water or solution when the pump is activated.

20 Claims, 9 Drawing Sheets

PORTABLE PRESSURE WASHER

FIELD OF THE INVENTION

The present invention relates in general to a portable pressure washer. More particularly, the present invention relates to a portable pressure washer that can be used to selectively dispense either water or a cleaning solution.

BACKGROUND OF THE INVENTION

There are a number of types of pressure washers that presently exist. For example, a handheld washer is shown in the Bertollini U.S. Pat. No. 5,169,068. A type of so-called portable pressure washer is also disclosed in U.S. Publication No. 2009/0269218 to Gardner et al. However, this system is large, cumbersome and requires an input fluid supply line. Another so-called portable pressure washer is shown in U.S. Pat. No. 6,565,015 to Leer et al. Again, this is a relatively large and cumbersome system using only a single liquid tank.

Thus, the prior art does not disclose a portable pressure washer as in accordance with the present invention wherein, onboard the device, there is provided at least one storage tank for water and a separate storage tank for a cleaning solution, along with a selection means for directing either the water or cleaning solution to a spray hose.

Accordingly, it is an object of the present invention to provide an improved portable pressure washer in which the pressure washer includes separate respective tanks for water and a cleaning solution.

Another object of the present invention is to provide an improved portable pressure washer in which a tank assembly is separable from a base, and in which the pressure washer is one that can be readily carried by a single individual.

Still another object of the present invention is to provide an improved pressure washer that incorporates, not only the pressure washing feature, but also a power inflator.

Still another object of the present invention is to provide an improved portable pressure washer that is constructed and arranged to have a helpful handle structure that enables the pressure washer to be readily carried by a user.

Another object of the present invention is to provide an improved portable pressure washer that is relatively simple in construction, that is easy to operate, and that provides a multitude of functions in a single device.

SUMMARY OF THE INVENTION

To accomplish the foregoing and other objects, features and advantages of the present invention there is provided a portable pressure washer comprising: a base and a tank assembly formed as a one-piece structure and for engagement with the base. The tank assembly includes at least one tank for accommodating a supply of water, and at least another tank for accommodating a cleaning solution. A liquid pump is disposed in the base and a manual selector is mounted at the base having separately selectable positions including a first position in which the pump is connected with the water tank, and a second position in which the pump is connected with the solution tank. A spray hose is coupled from the pump for directing either of the water or solution when the pump is activated.

In accordance with other aspects of the present invention there is a pair of water tanks that are separated from each other; the solution tank is smaller than either of the water tanks and is arranged between the pair of water tanks; an open bridge extends between the water tanks at a bottom of the water tanks so that the water in the water tanks is in fluid communication; a battery is disposed in the base and a switch mounted at the base for activating the pump; an air compressor is disposed in the base and a switch is mounted at the base for activating the air compressor; including a battery and a re-charging means for the battery; including a pair of tanks, all of the tanks having a filler cap, and a handle that extends between the respective tanks of the pair of tanks; including a shroud that extends about the tanks; and wherein the solution tank is smaller than either of the water tanks and is arranged between the pair of water tanks In accordance with another version of the present invention there is provided a portable pressure washer comprising: a base and a tank assembly formed as a one-piece structure and for engagement with the base. The tank assembly includes a pair of water tanks that are disposed separately from each other and a solution tank that is disposed between the pair of water tanks and each of the tanks is provided with a filler cap. A latch mechanism is disposed at opposite ends of the base for releasably securing the tank assembly with the base. A liquid pump is disposed in the base and a manual selector is mounted at the base having separately selectable positions including a first position in which the pump is connected with the water tanks, and a second position in which the pump is connected with the solution tank. A spray hose is coupled from the pump for directing either of the water or solution when the pump is activated.

In accordance with still other aspects of the present invention the solution tank is smaller than either of the water tanks and has a height that is less than the height of either of the pair of water tanks so as to provide an open space; including a handle that connects the respective water tanks of the pair of water tank, the open space enabling a grasping of the handle over the solution tank; including a battery in the base and a switch mounted at the base for activating the pump; including an air compressor disposed in the base and a switch mounted at the base for activating the air compressor; including a battery and a re-charging means for the battery; and including a shroud that extends about the tanks.

In accordance with still another version of the present invention there is provided a method of dispensing a liquid from a portable pressure washer that includes a tank assembly formed as a one-piece structure and for engagement with a base and in which the tank assembly includes at least one water tank and one solution tank, and a pump for pumping from the tanks and a manually operated selector at the base. The method comprises, activating the pump in a first position of the selector to pump the water from the water tank to an outlet hose, alternatively activating the pump in a second position of the selector to pump the solution from the solution tank to the outlet hose. The method may also include releasably latching the tank assembly to the base, and providing an air compressor, selectively switching on the air compressor and selectively switching on the pump.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Figure 1:
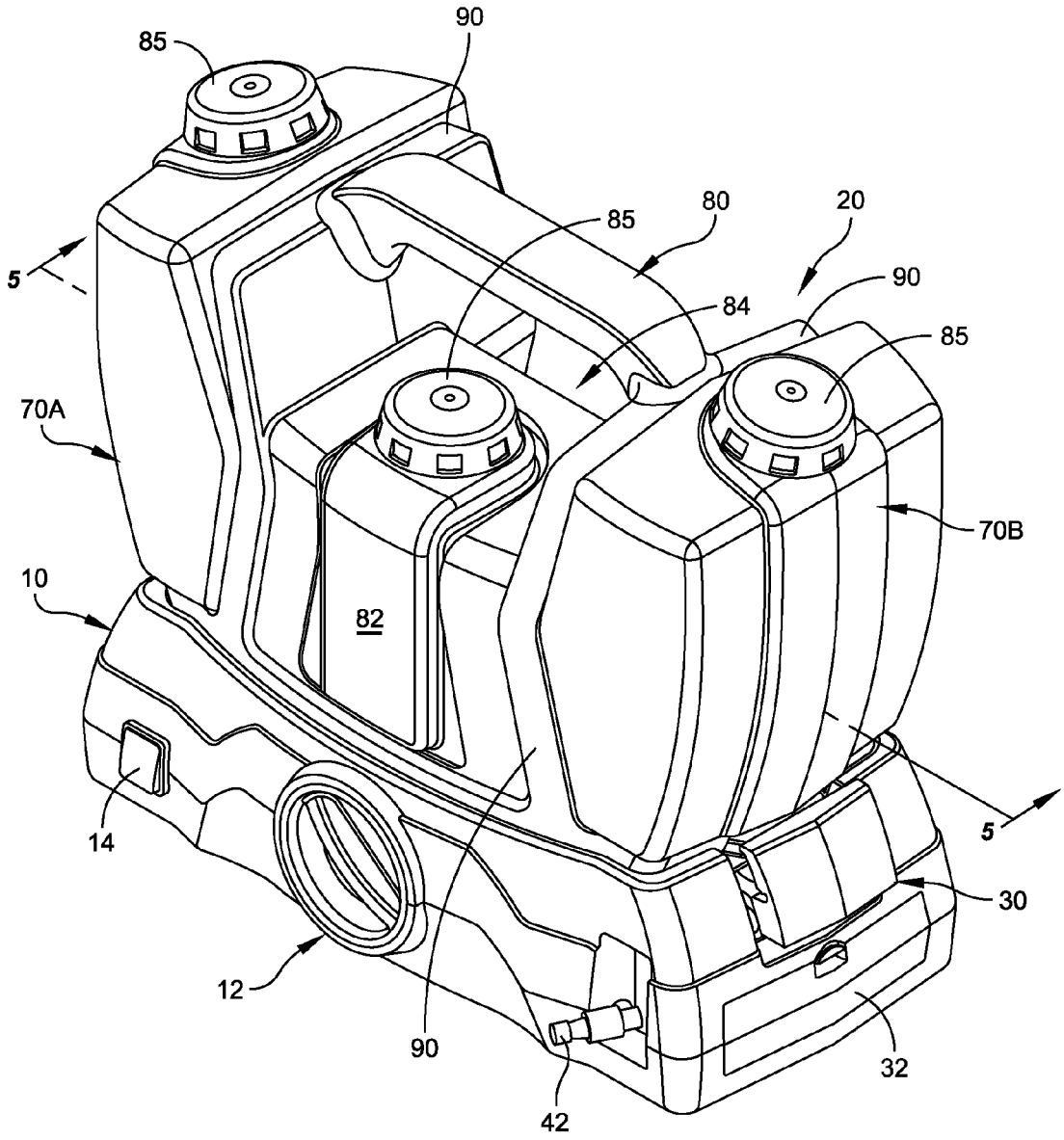
FIG. 1 is a perspective view of a preferred embodiment of the portable pressure washer of the present invention.
Figure 2:
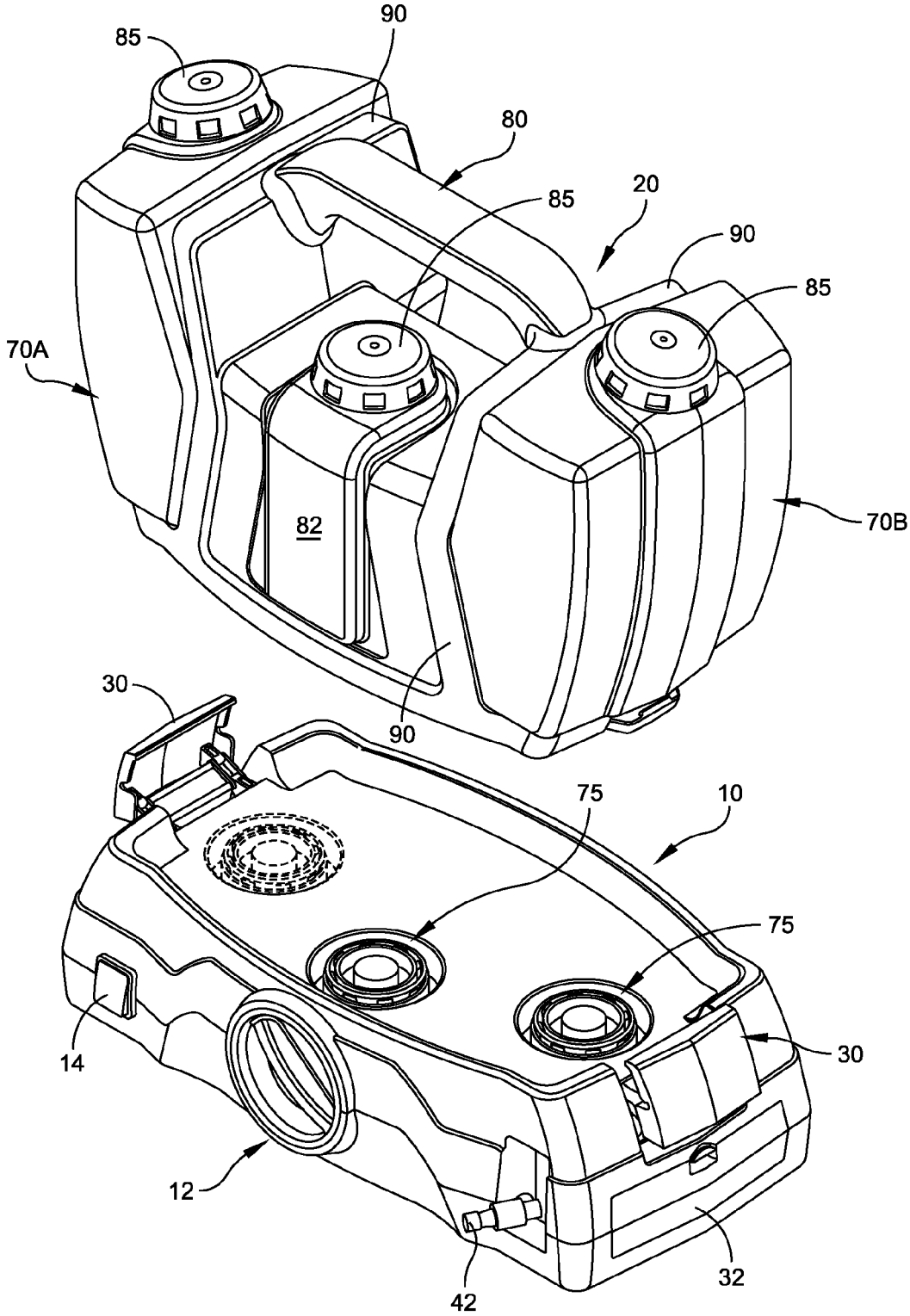
FIG. 2 is an exploded perspective view showing the tank assembly separate from the base.
Figure 3:
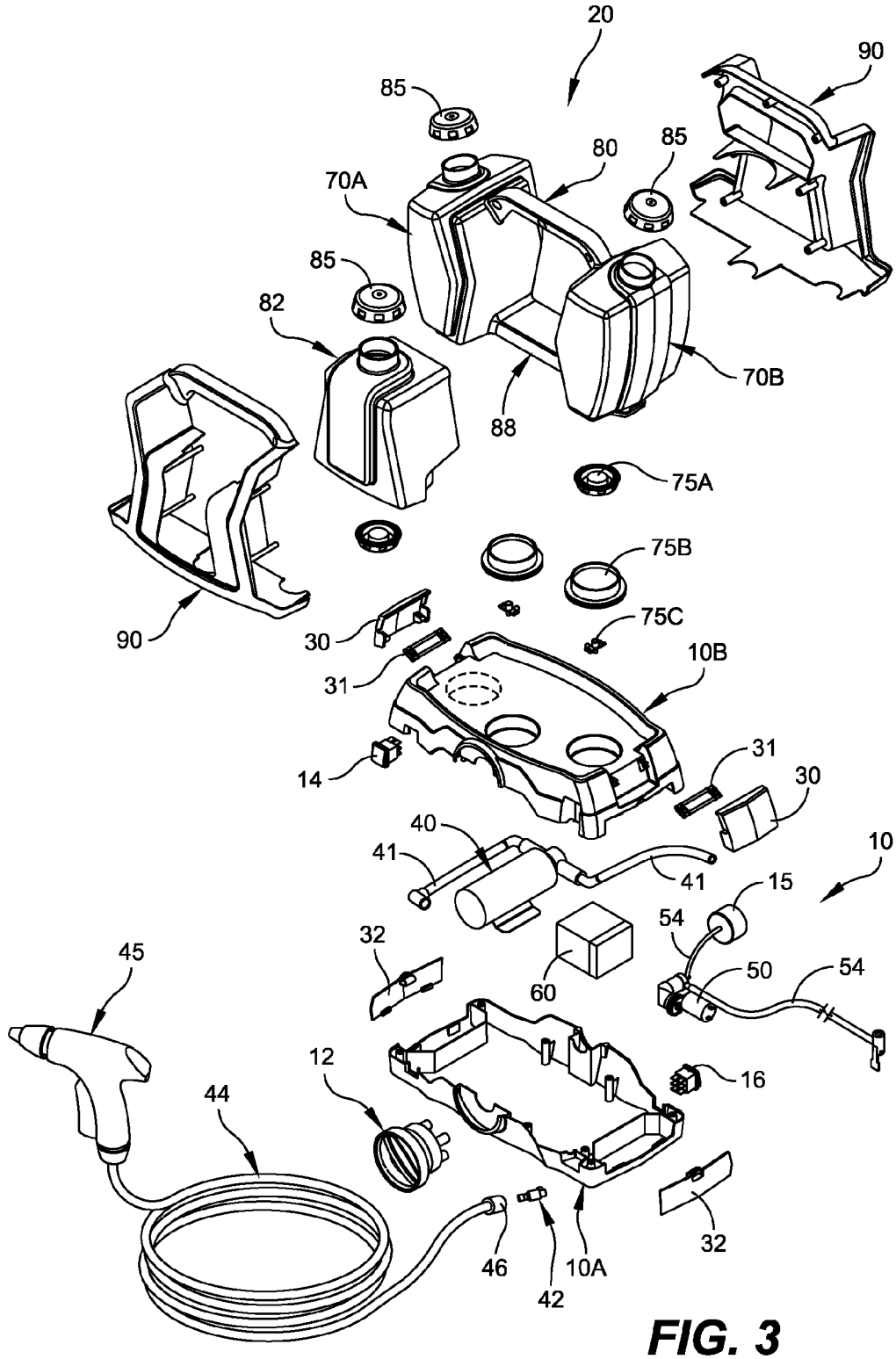
FIG. 3 is an exploded perspective view showing the various components that comprise the portable pressure washer.
Figure 4:
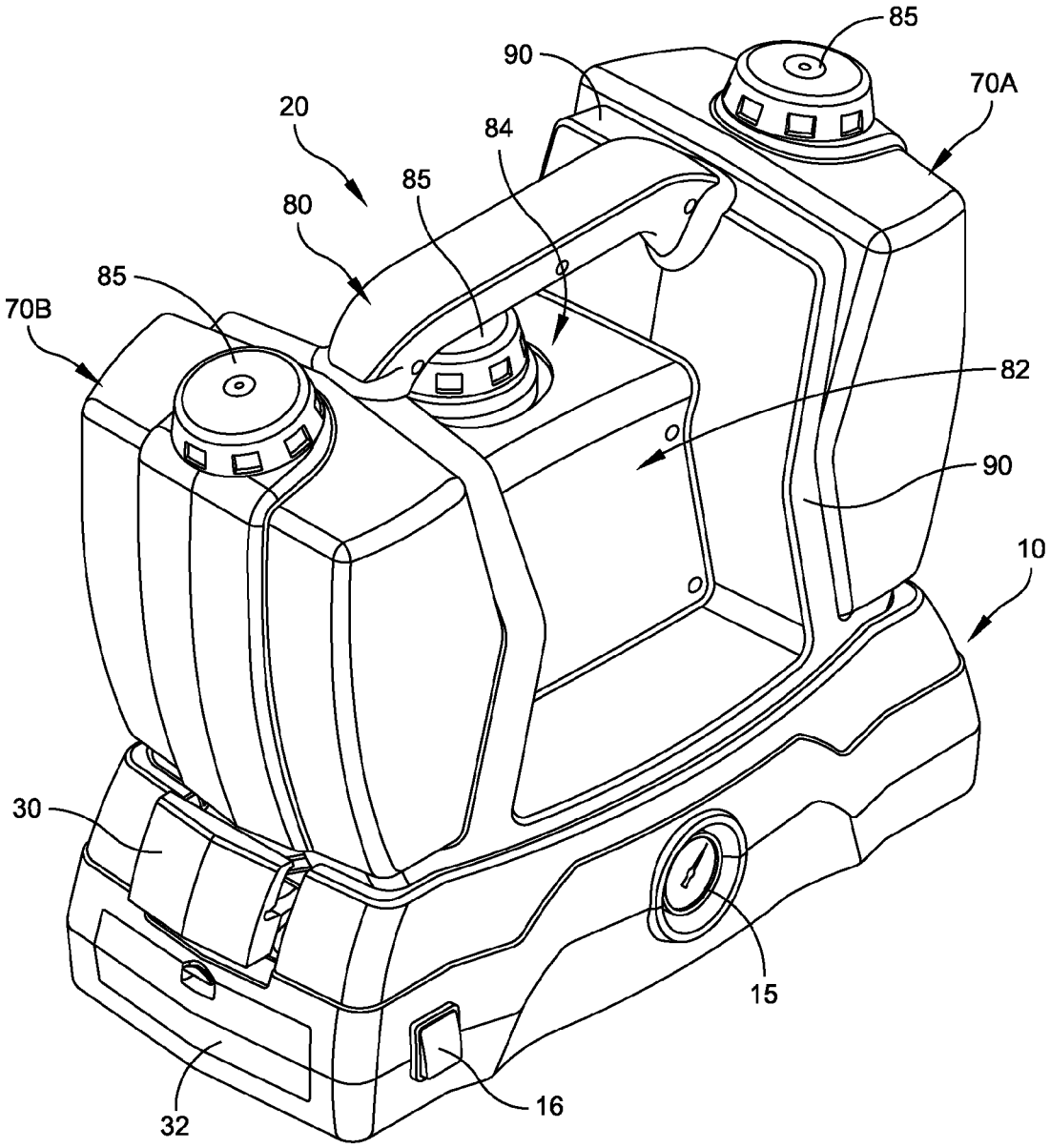
FIG. 4 is what may be considered a rear perspective view illustrating the other side of the portable pressure washer.

Reference is now made to the drawings for a preferred embodiment of the portable pressure washer of the present invention. The portable pressure washer may be considered as comprised of two main components including a base 10 and a tank assembly 20. These main components, and portions thereof, are preferably constructed of a hard plastic material and may be formed in a number of different manners. FIGS. 1 and 4 illustrate the tank assembly 20 in position on the base 10. FIG. 2 is an exploded perspective view illustrating the tank assembly 20 as separated from the base 10. FIG. 3 is an exploded perspective assembly view that illustrates virtually all the components that comprise the pressure washer.

Figure 5:
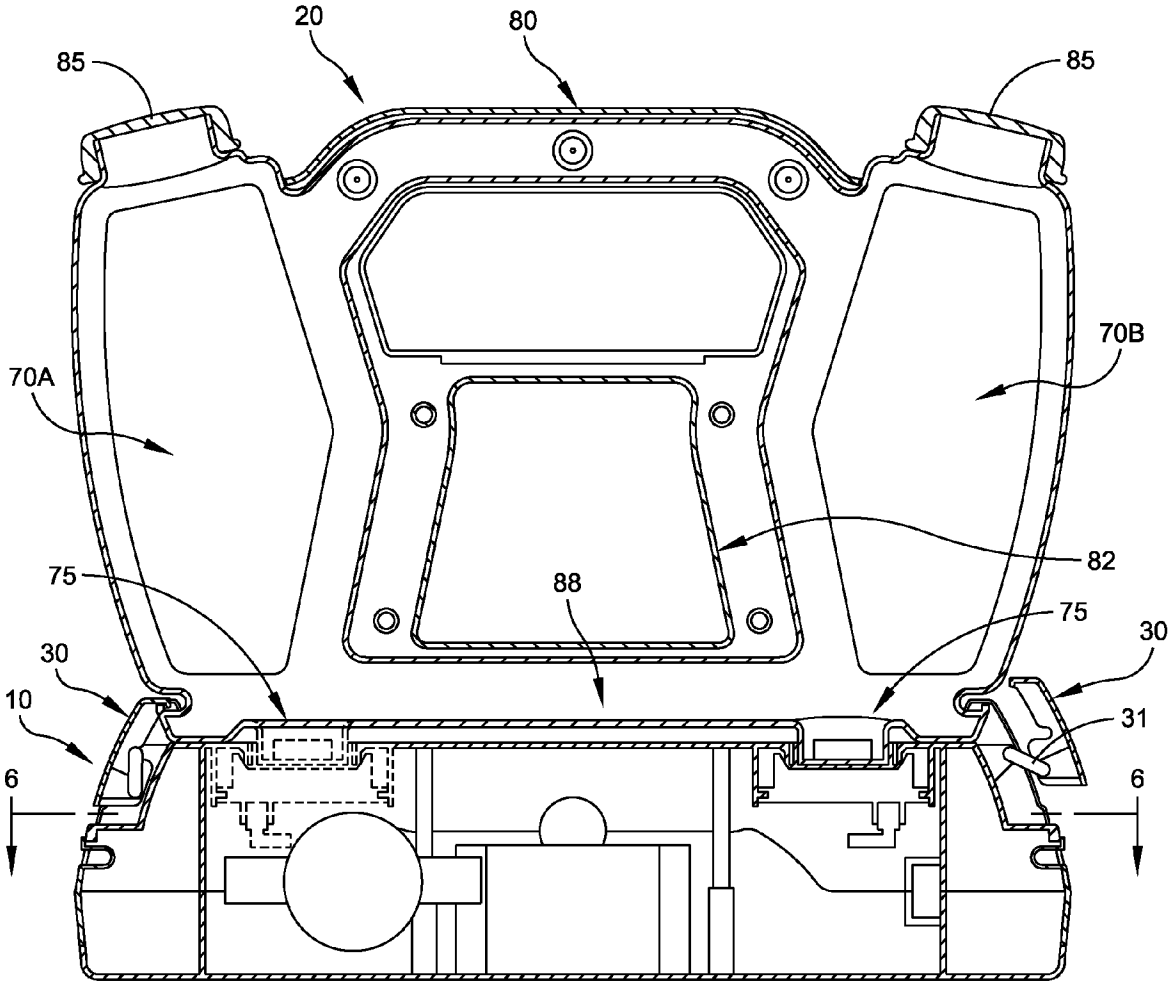
FIG. 5 is a cross-sectional view taken along line 5-5 of FIG. 1.
Figure 7:
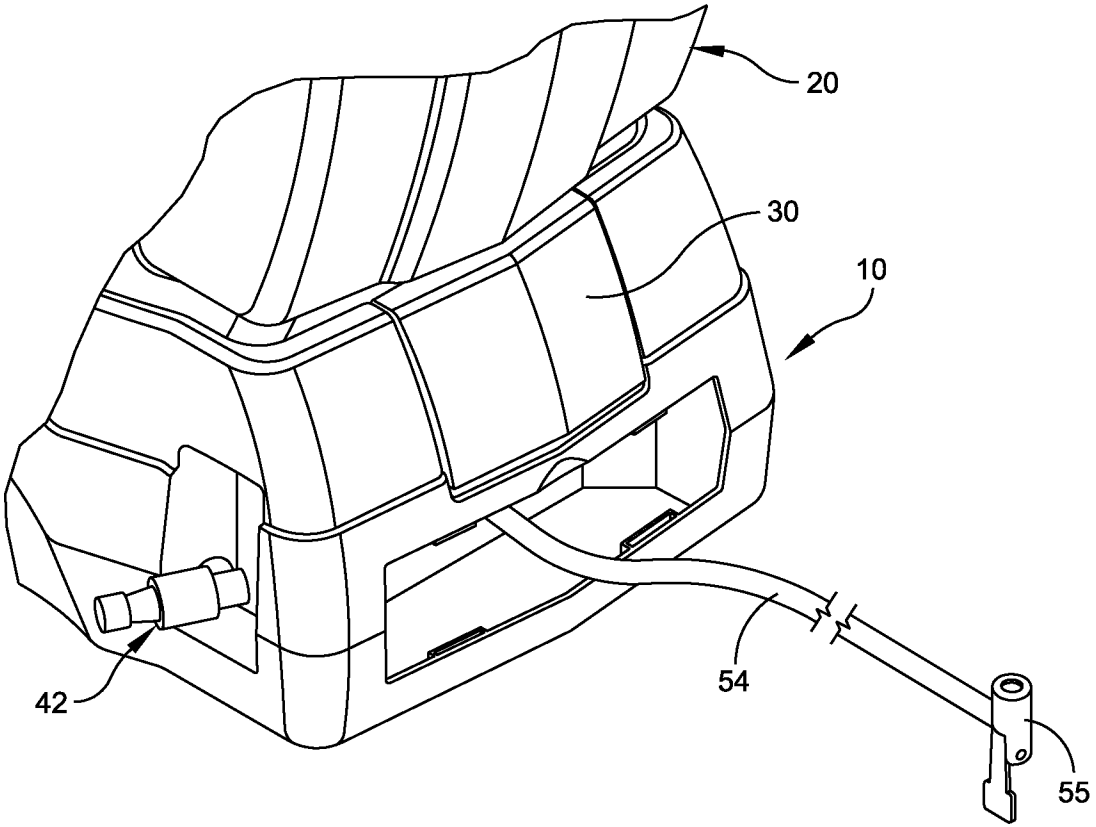
FIG. 7 is a fragmentary perspective view of the portable pressure washer at the air compressor end thereof.

The tank assembly 20 is secured in place on the base 10 by means of oppositely disposed latches 30. FIG. 2 illustrates both of the latches 30 in a more open position, while the cross-sectional view of FIG. 5 illustrates the left hand latch 30 in its engaged position in which an end of the latch is engaged within a recess of the tank assembly. In FIG. 5 the right hand latch 30 is shown about to be engaged with the recess in the tank assembly. Both of the latches 30 are engaged by pivoting downwardly to the final latched position shown at the left in FIG. 5. Below each of the latches 30 there is preferably provided an access door 32 that can either be in position as shown in FIG. 1 or removed as shown in, for example, FIG. 7 so as to provide access at opposite ends of the base for such items as power cords or inflator hoses. Thus, there is provided a compartment covered by the door 32 at each end of the base 10 for the storage of such items as re-charge means, hoses or inflator pieces.

With further reference also to FIG. 3, this exploded view illustrates that the base 10 may be comprised of separate sections 10A and 10B that together define the overall base structure. These sections may be interconnected in any well known manner such as by being glued together or screwed together. On one side, the base 10 supports the selector 12 on a sidewall thereof. The selector 12 is in essence a combined dial and valve, and controls whether water or a cleaning solution is to be pumped. The selector 12 is mounted at the base and has separately selectable positions including a first position in which it can connect with one or both water tanks and a second position in which it can connect with the solution tank. In this regard refer also to the schematic diagram of FIG. 9 that illustrates the selector 12 and associated tanks Also mounted on the base 10 is the pump switch 14. This is illustrated in, for example, FIG. 1 on one side of the base 10 and essentially adjacent to the selector 12. Refer also to the cross-sectional plan view at the base showing the pump switch 14. The switch 14 is for controlling the pump 40. Refer also to the exploded perspective view of FIG. 3 that shows the pump 40 and associated interconnecting fluid lines 41 associated therewith. On the opposite side of the base 10 there is also provided the air compressor control switch 16. This is illustrated on the opposite side of the base as illustrated in FIG. 4 and substantially adjacent to the pressure gauge 15. Refer also to the exploded perspective view of FIG. 3 that shows the air compressor 50 and associated lines that couple to the pressure gauge 15 as well as to an output hose. The compressor 50 is driven by a compressor motor 52. Refer to the cross-sectional view of FIG. 6 that illustrates the compressor 50 and the compressor motor 52, along with the pressure gauge 15 and interconnecting tubing at 54. Refer also to the fragmentary perspective view of FIG. 7 that shows a length of hose 54 coupling to a connector or head 55. The compressor may be of conventional design and include a piston/cylinder structure. The head 55 may also be of conventional type. The tubing or air inflation hose 54 may be of a sufficient length so that it can be coiled and left inside of the base when not in use. The connector 55 can be used for inflating, for example, tires, tubes or other inflatable products. In use a coil of the hose 54 pulled from its storage position within the base; the air compressor is activated from the switch 16; the hose is used to inflate tires; and at the same time the user can observe the pressure at the gauge 15.

FIG. 1 also illustrates a water hose connector 42 that may be of conventional design and preferably is constructed and arranged so that it can pivot between a use position as shown in FIG. 1 and a nested position within a cavity in the base 10. The connector 42 is coupled within the base by tubing 41 to the output of the pump 40. In FIG. 3 note the tubing at 41. FIG. 3 also illustrates a coil of hose at 44 connecting to a trigger nozzle 45. One end 46 of the hose 44 connects to the connector 42. The trigger nozzle may be of conventional design.

The switch 14 is for activating the pump 40. Refer also to the schematic block diagram of FIG. 9 that shows the switch 14 coupled to the pump 40. The pump 40 is also shown interconnecting with the selector 12. That line is a fluid line. Also illustrated, at the pump 40 there is illustrated an outlet at 47. This outlet at 47 is representative of the output hose 44 and trigger 45 as illustrated in FIG. 3.

Figure 6:
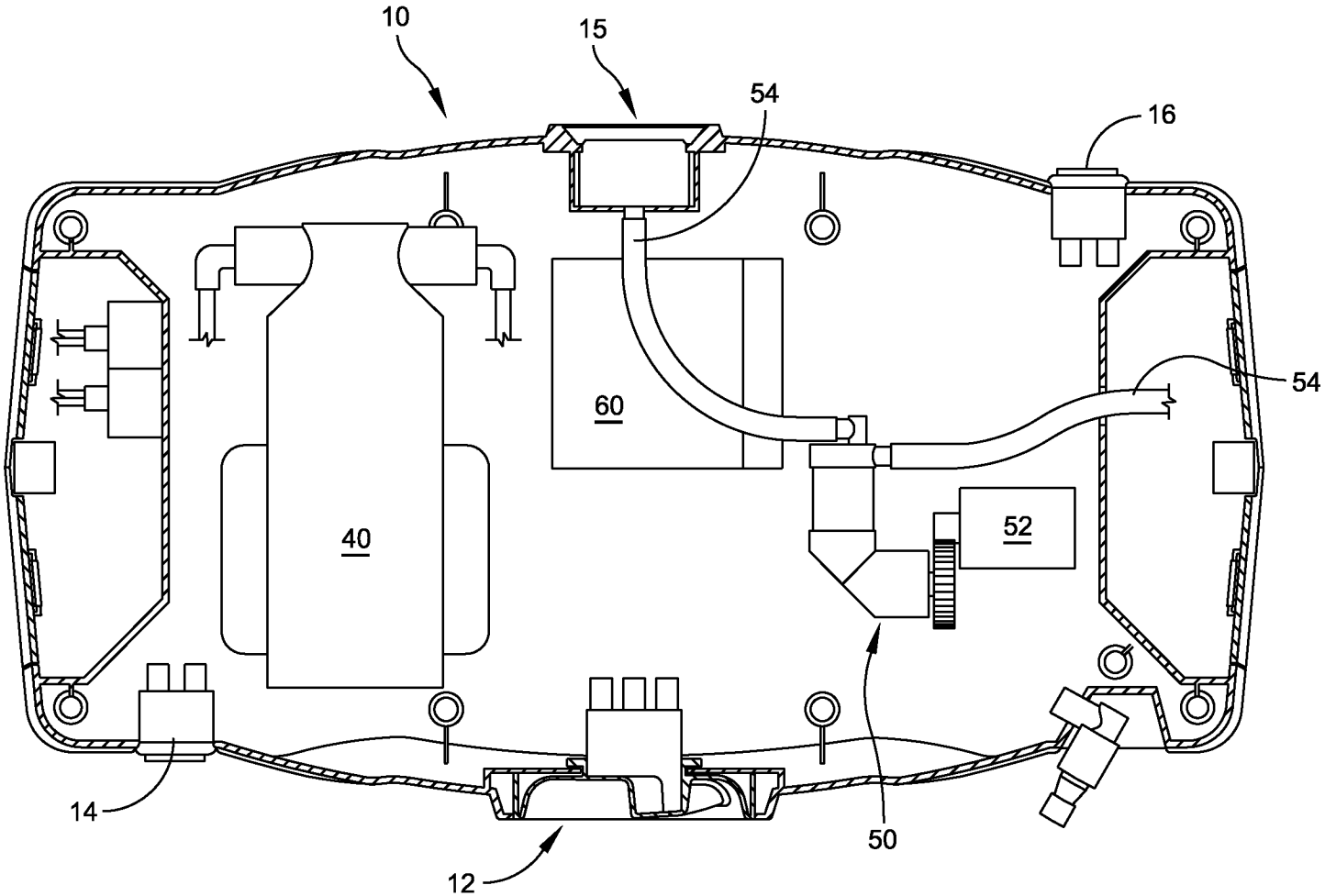
FIG. 6 is a cross-sectional view at the base as taken along line 6-6 of FIG. 5.
Figure 8:
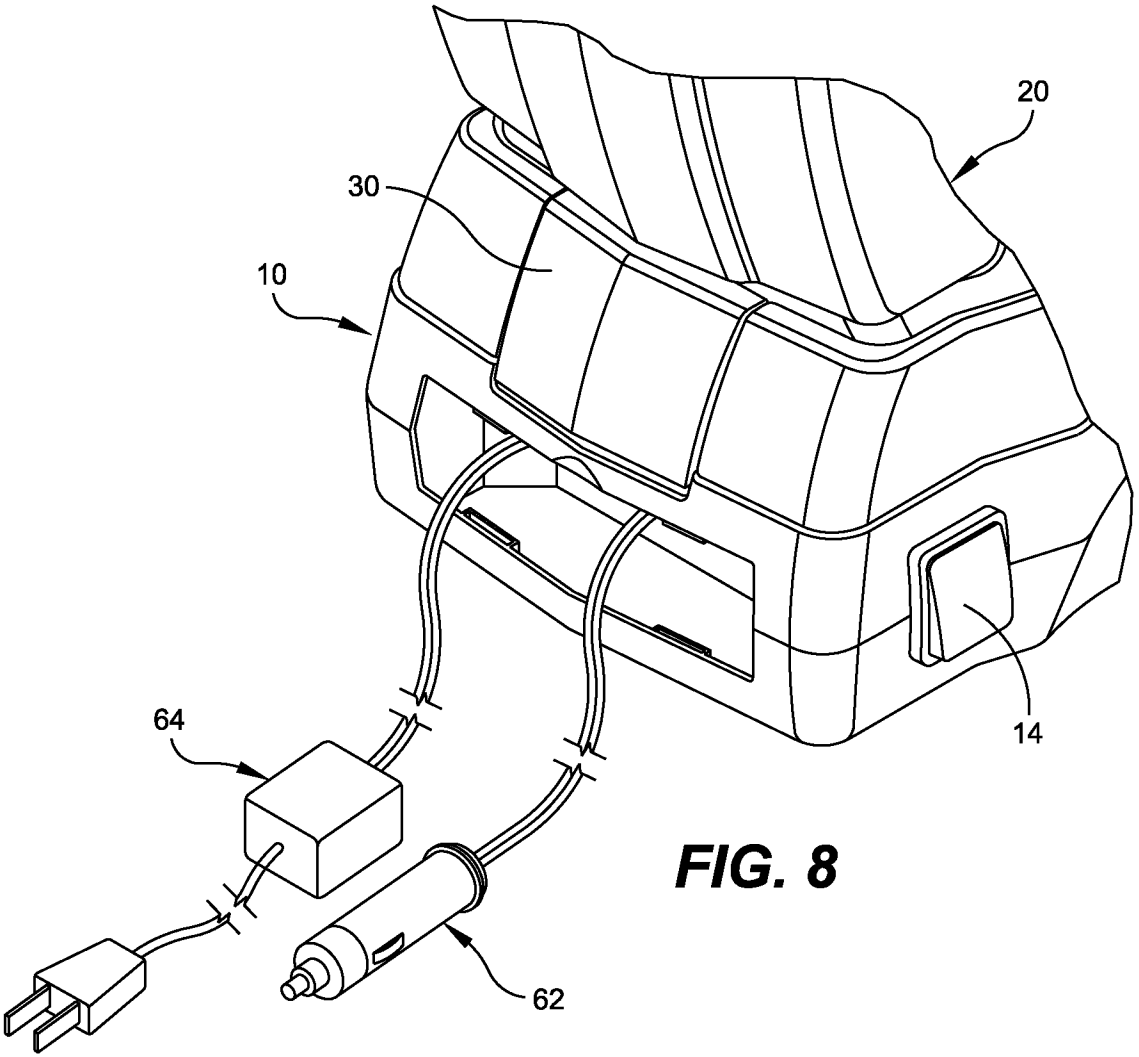
FIG. 8 is a fragmentary perspective view of the portable pressure washer at the power input end thereof.

The base 10 also houses the battery 60. Refer to the cross-sectional plan view of FIG. 6 for the position of the battery 60. In FIG. 6 many of the connections are not shown for the purpose of simplifying the description. However, it is understood that connections are made from the battery to at least the pump 40 and possibly also to the compressor 50 for powering either of these units. The battery 60 is preferably an 18 volt NiCad battery. The battery is preferably removable by a battery door that is not specifically illustrated herein. The battery 60 is preferably charged via a 12 volt DC car charger or via a 120 volt AC transformer charger. In this regard refer to the fragmentary perspective view of FIG. 8 that shows the car charger at 62 and the transformer charger at 64. It is preferred that the power washer portion of the device run off of the battery or off of the 120 volt car charger. The power inflator, on the other hand, is preferably run off of the 12 volt DC car charger or the 120 volt AC power outlet.

Reference is now made to FIGS. 1-5 for further details of the tank assembly 10. The tank assembly is comprised of at least one water tank and at least one solution tank. In the preferred embodiment that is disclosed in the drawings herein there are two water tanks 70A and 70B that are interconnected as a single unit. As part of this unit there is a handle 80 that couples between the separate tanks. The assembly also includes the solution tank 82 that is nested between the tanks 70A, 70B. The tank 82 is preferably smaller than either of the tanks 70A, 70B, and has a small height than the tanks 70A, 70B, so as to provide a space 84 thereabove. This space 84 enables easy grasping of the handle 80. Each of the tanks is also provided with a filler cap 85 that allows the tanks to be filled with either water or a cleaning solution.

In the embodiment that is disclosed, at the bottom end of each tank 70A, 70B there is a bridge 88 extending between the tanks that allows liquid communication between the separate water tanks Refer to FIGS. 3 and 5 that clearly illustrate this bridge. In an alternate embodiment the tanks 70A and 70B may be kept separate in which case there is an outlet vale associated with each tank. FIG. 3 also shows the separate shrouds 90 that cover the tanks 70A, 70B. These shrouds are interconnected in a known way such as with the use of an adhesive or screws. The shrouds essentially surround at least parts of all the tanks The shrouds also envelope the respective ends of the handle 80 such as shown in FIG. 1.

Refer now also to FIGS. 2, 3 and 5 for the valving that is associated with the tanks for controlling the flow of water or cleaning solution from the respective tanks The valves are closed when the tank assembly is separate from the base, as illustrated in, for example, FIG. 2.

See the valves 75 in FIG. 2. See also the cross-sectional view of FIG. 5 for the placement of the valves 75. In this way the tank assembly can be carried separately from the base without fear of spilling the water or cleaning solution. When the tank assembly is engaged with the base and latched in place then the respective valves open allowing fluid flow from the tanks to the pump. However, of course, no flow occurs until the pump is activated via the control switch 14. The valve 75 may be of conventional design including a tank valve portion 75A; a base valve portion 75C; and a base valve cover 75B. Virtually any valve arrangement can be used as long as it remains closed when the tank assembly is separate and opens when the tank assembly engages with the base.

Figure 9:
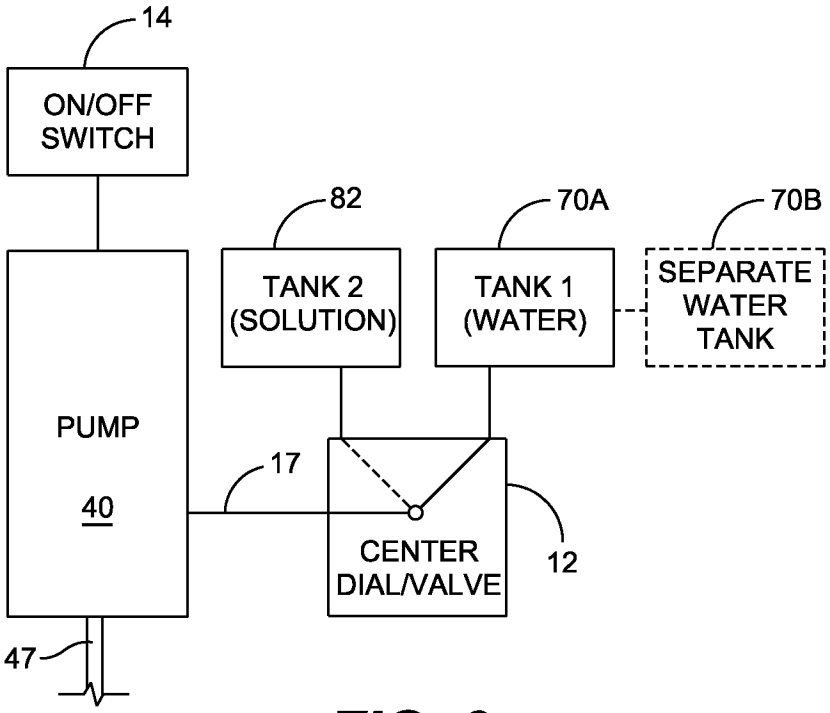
FIG. 9 is a schematic illustration of the components and interconnections therebetween.

Reference is now made to the schematic diagram of FIG. 9 for an illustration of the pump control in accordance with the present invention. FIG. 9 shows the pump 40 and its control switch 14. The outlet of the pump is to the spray trigger or a like device. The selector 12 controls what is being pumped. As such the tubing from either the tanks 70A, 70B is connected to the selector and the selector is a form of a flow switch that either couples the liquid from the water tanks or the liquid from the cleaning solution tank to the pump. The output tubing line from the selector 12 is shown in FIG. 9 at 17. Also shown in FIG. 9 are tubing lines connecting from the respective tanks to the selector 12. In FIG. 9 only one water tank is illustrated as connected to the selector. This because, although there are two tanks 70A, 70B they are in effect one single tank due to the bridge connection. If there were actually two completely separate tanks 70A, 70B (without the interconnecting bridge) the there would be a third input to the selector and a third valve as shown in dotted outline in FIGS. 2 and 5.

Having now described a limited number of embodiments of the present invention it should now be apparent to those skilled in the art that numerous other embodiments and modifications thereof are contemplated as falling within the scope of the present invention.

What is claimed is:

1. A portable pressure washer comprising:

a base;

a tank assembly formed as a one-piece structure and for engagement with the base;

said tank assembly including a pair of water tanks that are disposed separately from each other and a solution tank that is disposed between the pair of water tanks;

each of the tanks provided with a filler cap;

a latch mechanism at opposite ends of the base for releasably securing the tank assembly with the base;

a liquid pump disposed in the base;

a manual selector mounted at the base and having separately selectable positions including a first position in which the pump is connected with the water tanks, and a second position in which the pump is connected with the solution tank;

and a spray hose coupled from the pump for directing either of the water or solution when the pump is activated.

2. The portable pressure washer of claim 1 wherein the solution tank is smaller than either of the water tanks and has a height that is less than the height of either of the pair of water tanks so as to provide an open space.

3. The portable pressure washer of claim 2 including a handle that connects the respective water tanks of the pair of water tank, the open space enabling a grasping of the handle over the solution tank.

4. The portable pressure washer of claim 1 including a battery in the base and a switch mounted at the base for activating the pump.

5. The portable pressure washer of claim 1 including an air compressor disposed in the base and switch mounted at the base for activating the air compressor.

6. The portable pressure washer of claim 1 including a battery.

7. The portable pressure washer of claim 1 including a shroud that extends about the tanks.

8. The portable pressure washer of claim 1 wherein the solution tank is smaller than either of the water tanks.

9. The portable pressure washer of claim 1 including an open bridge that extends between the water tanks at a bottom of the water tanks so that the water in the water tanks is in fluid communication.

10. The portable pressure washer of claim 9 including a handle that extends between the respective tanks of the pair of tanks at a top end of the tanks.

11. The portable pressure washer of claim 1 including a handle that extends between the respective tanks of the pair of tanks at a top end of the tanks.

12. The portable pressure washer of claim 1 wherein the latch mechanism includes respective pivotal latches at opposite ends of the base for releasably securing the tank assembly with the base.

13. The portable pressure washer of claim 1 including a valve member disposed between at least one of the water tanks and the base and having a closed position until the tank assembly is engaged with the base.

14. The portable pressure washer of claim 1 including a valve member associated with each water tank and a valve member associated with the solution tank.

15. The portable pressure washer of claim 1 wherein each separate water tank includes opposed upright inner and outer walls defining opposed sides of each respective water tank.

16. The portable pressure washer of claim 15 wherein the respective inner walls of the water tanks are constructed and arranged in facing position but spaced apart to form an intermediate space therebetween.

17. The portable pressure washer of claim 16 including a fluid communication duct that extends between a bottom end of the respective inner walls so as to permit water flow between the water tanks.

18. The portable pressure washer of claim 17 including a handle that extends between the respective inner walls of the tanks of the pair of tanks at a top end of the tanks.

19. The portable pressure washer of claim 1 wherein the base has opposed ends each with a storage compartment thereat.

20. The portable pressure washer of claim 19 including a cover over each of the storage compartments.

* * * * *